US009249607B2

(12) United States Patent
Akizuki et al.

(10) Patent No.: US 9,249,607 B2
(45) Date of Patent: Feb. 2, 2016

(54) LATCH MECHANISM FOR A VEHICLE DOOR LOCK DEVICE

(75) Inventors: Ryujiro Akizuki, Novi, MI (US); Takashi Nishio, Kariya (JP); Nobuko Watanabe, Anjo (JP); Yasuhiko Sono, Hekinan (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 340 days.

(21) Appl. No.: 13/882,442

(22) PCT Filed: Oct. 4, 2011

(86) PCT No.: PCT/JP2011/073284

§ 371 (c)(1),
(2), (4) Date: Jul. 24, 2013

(87) PCT Pub. No.: WO2012/056869

PCT Pub. Date: May 3, 2012

(65) Prior Publication Data

US 2013/0300137 A1 Nov. 14, 2013

(30) Foreign Application Priority Data

Oct. 29, 2010 (JP) ..... 2010-243094

(51) Int. Cl.
*E05B 9/00* (2006.01)
*E05B 85/02* (2014.01)
(Continued)

(52) U.S. Cl.
CPC ..... *E05B 85/02* (2013.01); *E05B 77/38* (2013.01); *E05B 85/26* (2013.01); *Y10T 292/62* (2015.04)

(58) Field of Classification Search
CPC . Y10T 292/688; Y10T 74/2135; E05B 77/38; E05B 15/022; E05B 77/36; E05B 15/0255; Y10S 292/56; Y10S 292/73
USPC ..... 292/337, 227, 340, 341, 341.11, 292/341.13, DIG. 56, DIG. 38
See application file for complete search history.

(56) References Cited

U.S. PATENT DOCUMENTS 4,073,519 A * 2/1978 Kurozu et al. ..... 292/216
4,679,836 A 7/1987 Pupillo et al.
(Continued)

FOREIGN PATENT DOCUMENTS

DE 22 18 734 A1 10/1973
DE 20 2007 017195 U1 2/2008
(Continued)

OTHER PUBLICATIONS

U.S. App. No. 13/579,181, filed Aug. 15, 2012, Akizuki et al.
(Continued)

*Primary Examiner* — Mark Williams
(74) *Attorney, Agent, or Firm* — Buchanan Ingersoll & Rooney PC

(57) ABSTRACT

A vehicle door latch mechanism includes a resin body, a base plate and a sub base plate nipping this body. The body has an accommodating portion capable of accommodating a latch and a pawl, an insertion groove through which a striker is inserted, a cantilever support portion nipping the striker with a facing inner wall surface, a receiving portion for restricting inclination of the cantilever support portion to a predetermined amount, and a cushion accommodating portion capable of accommodating a cushion for pressing the cantilever support portion toward the striker. A support portion for suppressing a deformation of the receiving portion when a free front end of the cantilever support portion is engaged with the receiving portion is provided in the sub base plate.

7 Claims, 4 Drawing Sheets

(51) Int. Cl.
*E05B 85/26* (2014.01)
*E05B 77/38* (2014.01)

(56) References Cited

U.S. PATENT DOCUMENTS

| | | | | |
|---|---|---|---|---|
| 5,106,134 | A * | 4/1992 | Thau | 292/216 |
| 5,141,270 | A * | 8/1992 | Shibata | 292/216 |
| 7,845,692 | B2 * | 12/2010 | Inan et al. | 292/216 |
| 2006/0087126 | A1 * | 4/2006 | Roussel | 292/116 |

FOREIGN PATENT DOCUMENTS

| | | | |
|---|---|---|---|
| DE | 10 2009 016477 | A1 | 10/2010 |
| JP | 2001-098821 | A | 4/2001 |
| JP | 2002-129810 | A | 5/2002 |

OTHER PUBLICATIONS

International Search Report (PCT/ISA/210) issued on Feb. 10, 2012, by the European Patent Office as the International Searching Authority for International Application No. PCT/JP2011/073284.

Written Opinion (PCT/ISA/237) issued on Feb. 10, 2012, by the European Patent Office as the International Searching Authority for International Application No. PCT/JP2011/073284.

U.S. Appl. No. 13/882,846, filed May 1, 2013, Akizuki et al.

* cited by examiner

LATCH MECHANISM FOR A VEHICLE DOOR LOCK DEVICE

BACKGROUND OF THE INVENTION

1. Field of the Invention

The present invention relates to a latch mechanism for a vehicle door lock device.

2. Description of the Related Art

One example of the latch mechanism of the vehicle door lock device is described in JP2002-129810 A. The latch mechanism described in JP2002-129810 A includes a resin body, a base plate arranged on one side of the body, and a sub base plate arranged on the other side of the body. The body has an accommodating portion capable of accommodating a latch and a pawl. The latch is pushed and rotated by a striker attached on the vehicle body side. The pawl is engageable with and disengageable from the latch inside the accommodating portion. The body also has an insertion groove through which the striker is inserted, and a cantilever support portion (tongue shape portion) serving as a part of the insertion groove. The striker is nipped between the cantilever support portion and a facing inner wall surface of the insertion groove. The body further has a receiving portion engageable with a free front end of the cantilever support portion for restricting inclination of the cantilever support portion to a predetermined amount, and a cushion accommodating portion provided on the receiving portion side of the cantilever support portion for accommodating a cushion for pressing the cantilever support portion toward the striker. The base plate has an attachment hole for assembling to a door of the vehicle, a latch axial hole for pivotally supporting a latch support shaft supporting the latch, a pawl axial hole for pivotally supporting a pawl support shaft supporting the pawl, and an insertion groove through which the striker is inserted. The sub base plate has a latch axial hole for pivotally supporting the latch support shaft, and a pawl axial hole for pivotally supporting the pawl support shaft. It should be noted that the cantilever support portion (tongue shape portion), the receiving portion, the cushion accommodating portion, and the like of the body are described in detail in JP2001-98821 A.

SUMMARY OF THE INVENTION

According to the above described latch mechanism of the vehicle door lock device described in JP2002-129810 A, the striker is nipped between the cantilever support portion serving as a part of the insertion groove and the facing inner wall surface of the insertion groove when the striker is inserted through an interior of the insertion groove. At this time, a reactive force against the nipping force is acted to the cantilever support portion from the striker. The cantilever support portion is abutted with the receiving portion by the reactive force, so that inclination of the cantilever support portion due to the reactive force is restrained. The receiving portion is deflected by the reactive force, thereby the receiving portion is deformed. The latch mechanism described in JP2002-129810 A does not provide a specific prevention measure for such deformation of the receiving portion.

The present invention is achieved in order to solve the above problem. The present invention provides a latch mechanism for a vehicle door lock device comprising a resin body, the body having an accommodating portion capable of accommodating a latch adapted to be pushed and rotated by a striker attached on the vehicle body side and a pawl engageable with and disengageable from the latch inside thereof, an insertion groove adapted to be that through which the striker is inserted, a cantilever support portion serving as a part of the insertion groove and adapted to nip the striker with facing inner wall surface of the insertion groove, a receiving portion engageable with a free front end of the cantilever support portion for restricting inclination of the cantilever support portion to a predetermined amount, and a cushion accommodating portion provided on the receiving portion side of the cantilever support portion, the cushion accommodating portion being capable of accommodating a cushion adapted to press the cantilever support portion toward the striker. The latch mechanism of the present invention further comprises a support portion. The support portion suppresses a deformation of the receiving portion when the free front end of the cantilever support portion is engaged with the receiving portion and the receiving portion deforms.

In this case, the latch mechanism of the present invention may further comprises a base plate arranged on one side of the body, and a sub base plate arranged on the other side of the body. It is preferable that the base plate and the sub base plate rotatably support the latch and/or the pawl. The support portion may be integrally formed in the sub base plate. The base plate may have an attachment hole for assembling to a door of the vehicle, a latch axial hole for pivotally supporting a latch support shaft supporting the latch, a pawl axial hole for pivotally supporting a pawl support shaft supporting the pawl, and an insertion groove adapted to be that through which the striker is inserted. The sub base plate may have a latch axial hole for pivotally supporting the latch support shaft, and a pawl axial hole for pivotally supporting the pawl support shaft. The support portion may have a support surface capable of being abutted with a deformed surface of the receiving portion in an intermediate part thereof. The support portion may connect to a part where the latch axial hole of the sub base plate is formed at one end, and connect to a part where the pawl axial hole of the sub base plate is formed at the other end.

In the latch mechanism of the vehicle door lock device according to the present invention, the support portion is provided for suppressing the deformation of the receiving portion when the free front end of the cantilever support portion is engaged with the receiving portion and the receiving portion deforms. Therefore, at the time of installing and using the latch mechanism of the present invention in a vehicle, and in the case where large force is applied to the receiving portion of the body from the striker via the cantilever support portion, the support portion restrains the receiving portion, so that the deformation of the receiving portion is suppressed. As a result, an operation reliability of the latch mechanism can be improved.

Upon implementation of the present invention described above, in the case where the support portion is integrally formed in the sub base plate, the operation reliability of the latch mechanism can be improved without increasing the number of parts. In the case where the support portion integrally formed in the sub base plate has a support surface capable of being abutted with a deformed surface of the receiving portion in an intermediate part thereof, with one end being connected to a part where the latch axial hole of the sub base plate is formed, and with the other end being connected to a part where the pawl axial hole of the sub base plate is formed, support rigidity of the support portion can be enhanced, and the receiving portion can be appropriately supported at the support surface of the support portion.

DETAILED DESCRIPTION OF THE INVENTION

Figure 1:
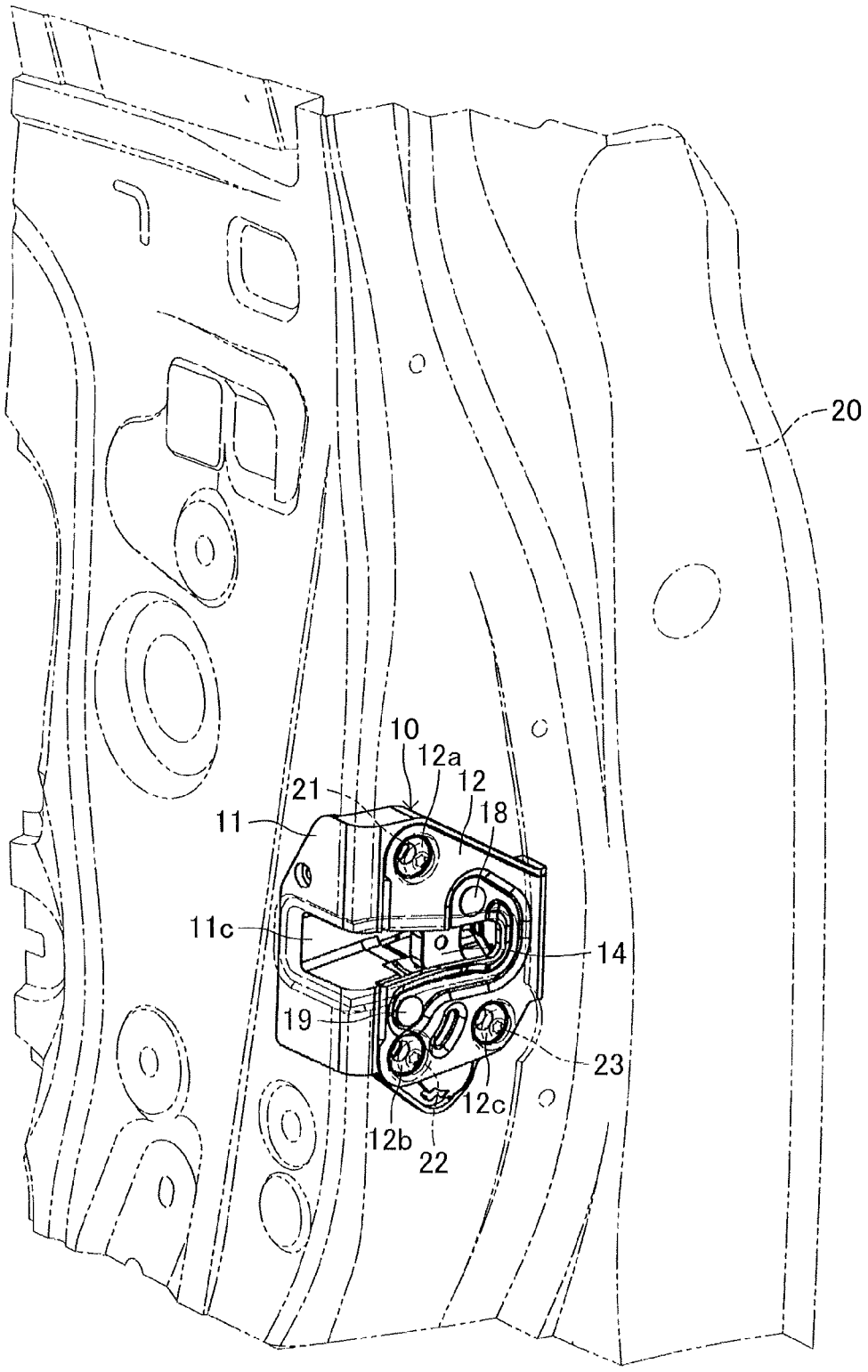
FIG. 1 is a perspective view showing one embodiment of a latch mechanism for a vehicle door lock device according to the present invention together with a door.
Figure 2:
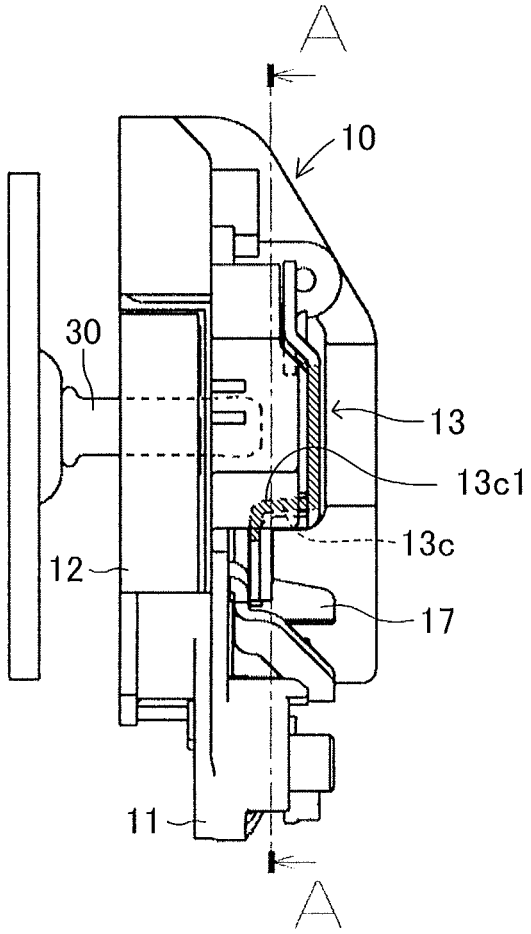
FIG. 2 is a side view of the latch mechanism shown in FIG. 1 and a striker engageable with and disengageable from the latch mechanism seen from the outdoor side of a vehicle.

Hereinafter, one embodiment of the present invention will be described based on the drawings. FIGS. 1 to 6 show a latch mechanism 10 of a vehicle door lock device according to the present invention. The latch mechanism 10 is installed in a door 20 (refer to an imaginary line in FIG. 1) disposed on the front right side of a vehicle together with a lock mechanism (not shown). The latch mechanism 10 includes a resin body 11, a base plate 12 made of a steel plate (metal), and a sub base plate 13 made of a steel plate (metal). Further, the latch mechanism 10 includes a metal latch 14, a latch return spring S1 made of spring steel, a metal pawl 15, a pawl return spring S2 made of spring steel, a rubber stopper 16, and a lift lever 17 made of a steel plate.

Figure 4:
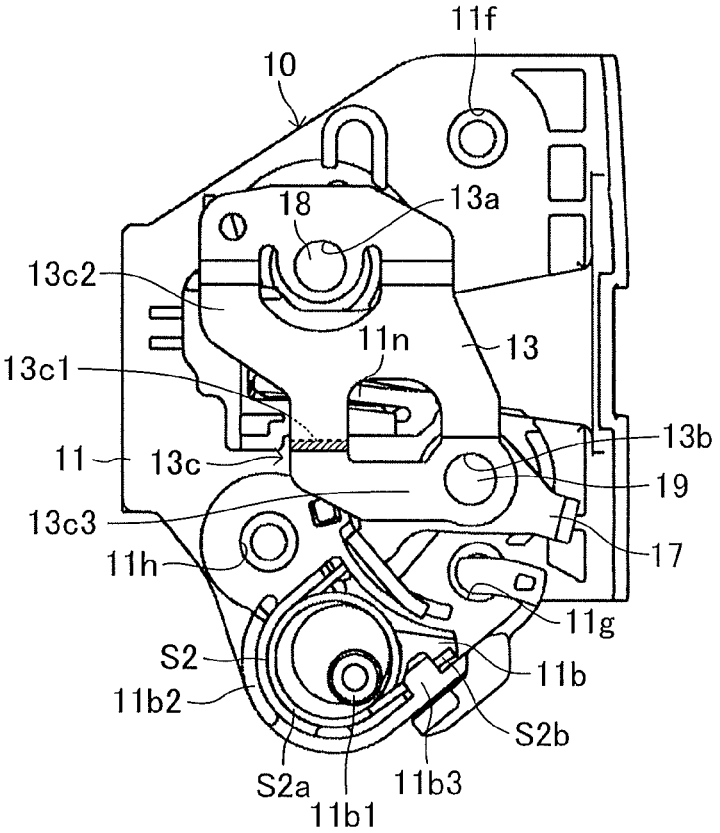
FIG. 4 is a front view of the latch mechanism shown in FIG. 2 seen from the front side of the vehicle.
Figure 5:
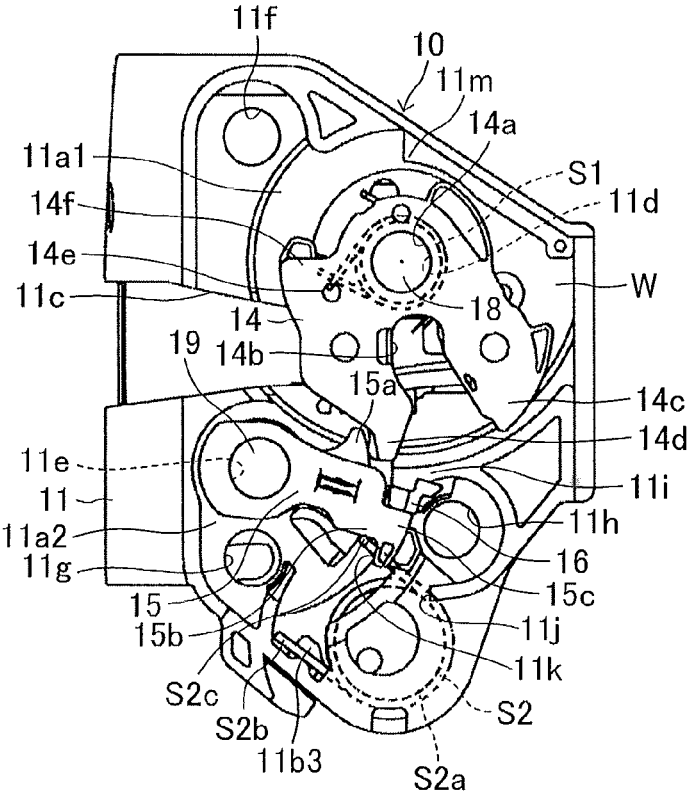
FIG. 5 is a back view which shows a state that a base plate is detached from the latch mechanism shown in FIG. 2.

As shown in FIG. 5, in the body 11, an accommodating portion 11*a*1 for accommodating the latch 14 and an accommodating portion 11*a*2 for accommodating the pawl 15 are formed on one side of a vertical wall W placed between the base plate 12 and the sub base plate 13. That is, the accommodating portions 11*a*1 and 11*a*2 are provided in the body 11 on one side in which the base plate 12 is assembled. Meanwhile, as shown in FIG. 4, a spring attachment portion 11*b* for assembling the pawl return spring S2 is formed on the other side of the vertical wall W. That is, the spring attachment portion 11*b* is provided in the body on the other side in which the sub base plate 13 is assembled. In the body 11, a striker insertion groove 11*c*, two support shaft insertion holes 11*d*, 11*e*, three bolt insertion holes 11*f*, 11*g*, 11*h*, and a stopper attachment portion 11*i* are formed. Further, in the body 11, a cutout 11*j*, a through hole 11*k*, and a projection 11*m* are formed. Further, in the body 11, a cantilever support portion 11*n*, a receiving portion 11*o*, and a cushion accommodating portion 11*p* are formed.

Figure 3:
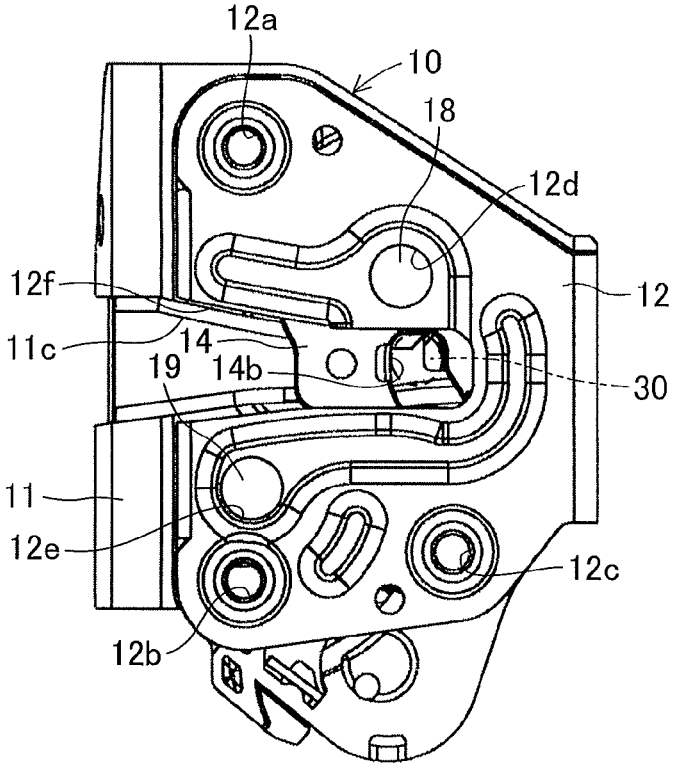
FIG. 3 is a back view of the latch mechanism shown in FIG. 2 seen from the rear side of the vehicle.

As shown in FIG. 5, the accommodating portion 11*a*1 formed in upper portion of the body 11 accommodates the latch 14 so that the latch can be rotated by a predetermined amount. The projection 11*m* protrudes inward from a wall surface forming the accommodating portion 11*a*1. The projection 11*m* regulates a return position of the latch 14 (position where the latch 14 is rotated in the clockwise direction by a predetermined amount from a position shown in FIG. 5). As shown in FIG. 5, accommodating portion 11*a*2 formed in lower portion of the body 11 accommodates the pawl 15 so that the pawl can be rotated by a predetermined amount. The accommodating portion 11*a*2 communicates with the upper accommodating portion 11*a*1 in a part where the pawl 15 is engaged with the latch 14. It should be noted that one side surface of the accommodating portions 11*a*1, 11*a*2 is partially covered by the base plate 12 as shown in FIG. 3.

Figure 6:
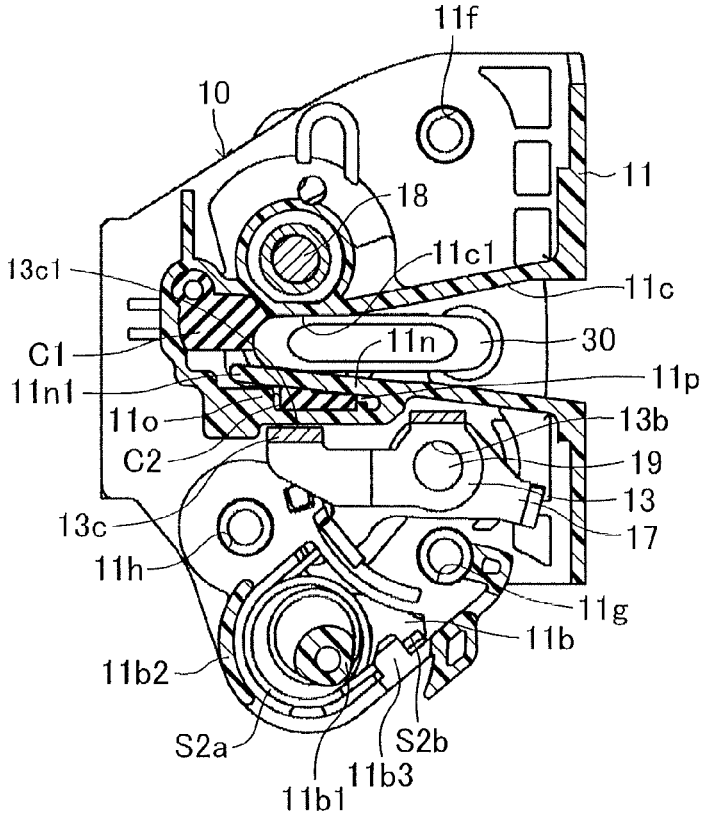
FIG. 6 is a sectional view along the line A-A of FIG. 2.

As shown in FIG. 4, the spring attachment portion 11*b* is formed on the other side of the body 11 at a position away from a rotation support portion (the position in which the pawl support shaft 19 is provided) of the pawl 15 toward the obliquely lower direction in FIG. 4. As shown in FIGS. 4 and 6, the spring attachment portion 11*b* has a shaft portion 11*b*1 retaining a coil portion S2*a* of the pawl return spring S2, an arc wall portion 11*b*2 surrounding the coil portion S2*a*, and a locking portion 11*b*3 to be engaged with one end (body side end) S2*b* of the pawl return spring S2 at which the pawl return spring S2 engages with the body 11.

A known striker 30 (refer to FIGS. 2 and 6) assembled on the vehicle body side comes into and retreats from the striker insertion groove 11*c* at the time of opening and closing the door 20. The striker insertion groove 11*c* is horizontally formed in a center of the body 11. It should be noted that as shown in FIG. 6, a rubber cushion C1 for elastically receiving incoming of the striker 30 is assembled to a closed end of the striker insertion groove 11*c*. A latch support shaft 18 rotatably supporting the latch 14 is inserted into the support shaft insertion hole 11*d* formed on the upper side of the striker insertion groove 11*c* in FIG. 5. Meanwhile, the pawl support shaft 19 rotated integrally with the pawl 15 is inserted into the support shaft insertion hole 11*e* formed on the lower side of the striker insertion groove 11*c* in FIG. 5.

The latch mechanism 10 is assembled to the door 20 by using three bolts 21, 22 and 23. The bolts 21, 22 and 23 are screwed into bolt attachment hole portions (female screw portions) 12*a*, 12*b* and 12*c* each provided in the base plate 12. Front ends of bolts 21, 22 and 23 are inserted into the three bolt insertion holes 11*f*, 11*g* and 11*h* each provided in the body 11. As shown in FIG. 5, the stopper attachment portion 11*i* is provided between the accommodating portions 11*a*1 and 11*a*2. The stopper 16 is fitted and fixed to the stopper attachment portion 11*i*.

As shown in FIG. 5, the cutout 11*j* is provided in a lower part on one side of the body 11 (one side of the vertical wall W). An opening portion is formed by the cutout 11*j* and the base plate 12. With this opening portion, the accommodating portions 11*a*1, 11*a*2 open downward on the lower side of the pawl 15. The opening portion is formed into a rectangular shape when seen from the lower side. The through hole 11*k* is formed into an arc shape on the vertical wall W between the accommodating portion 11*a*2 and the spring attachment portion 11*b*. The other end S2*c* (pawl side end) of the pawl return spring S2 can be inserted into the through hole 11*k*.

As shown in FIG. 6, the cantilever support portion 11*n* serves as a part (a lower part of a wall surface) of the striker insertion groove 11*c*. When the striker 30 is inserted through the striker insertion groove 11*c*, the striker 30 is nipped between the cantilever support portion 11*n* and a facing inner wall surface 11*c*1. The facing inner wall surface 11*c*1 faces the cantilever support portion 11*n* and forms the upper side of the striker insertion groove 11*c*. A front end of the cantilever support portion 11*n* serves as a free end. The receiving portion 11*o* is provided on the lower side of the cantilever support portion 11*n* in FIG. 6. The receiving portion 11*o* can be engaged with a free front end 11*n*1 of the cantilever support portion 11*n*. When the free front end 11*n*1 of the cantilever support portion 11*n* is moved downward in FIG. 6, the receiving portion 11*o* is brought into contact with the free front end 11*n*1. The free front end 11*n* 1 is brought into contact with the receiving portion 11*o*, so that downward inclination (downward movement) of the cantilever support portion 11*n* is restricted to a predetermined amount. The cushion accommodating portion 11*p* is provided on the lower side (side in which the receiving portion 11*o* is arranged) of the cantilever support portion 11*n* in FIG. 6, and is capable of accommodating a rubber cushion C2 for pressing the cantilever support portion 11*n* toward the striker 30.

As shown in FIG. 3, the base plate 12 has the bolt attachment hole portions (female screw portions) 12*a*, 12*b* and 12*c*. Further, the base plate 12 has a latch axial hole 12*d*, a pawl axial hole 12*e*, and a striker insertion slit 12*f*. The latch axial hole 12*d* supports one end side of the latch support shaft 18 pivotally. The pawl axial hole 12*e* supports one end side of the pawl support shaft 19 pivotally. The base plate 12 is connected to the sub base plate 13 via the support shafts 18, 19. As shown in FIG. 4, the sub base plate 13 has a latch axial hole 13*a* and a pawl axial hole 13*b*. The latch axial hole 13*a* supports the other end side of the latch support shaft 18 pivotally. The pawl axial hole 13*b* supports the other end side of the pawl support shaft 19 pivotally. The sub base plate 13 is arranged so as to nip the body 11 and a lift lever 17 with the base plate 12.

As shown in FIGS. 4 and 6, a support portion 13*c* is integrally provided in the sub base plate 13. The support portion 13*c* suppresses a deformation of the receiving portion 11*o* of the body 11 when the receiving portion 11*o* is deformed. As shown by a diagonal line of FIG. 2, the support portion 13*c* is formed by a part of the sub base plate 13 and configured so as to have a crank shape. The support portion 13*c* has a support surface 13*c*1 (upper surface) in an intermediate part thereof (step part of a crank shape). The support surface 13*c*1 is arranged at the lower side of the receiving portion 11*o*, and configured to be capable of being abutted with a deformed surface (lower surface) of the receiving portion 11*o*. As shown in FIG. 4, the support portion 13*c* has one end 13*c*2 connected to a part where the axial hole 13*a* of the sub base plate 13 is formed, and the other end 13*c*3 connected to a part where the axial hole 13*b* of the sub base plate 13 is formed.

The latch 14 is rotatably supported on the base plate 12 and the sub base plate 13 via the latch support shaft 18. The latch 14 has an attachment hole 14*a*, a striker retaining groove 14*b*, a half latch claw 14*c*, and a full latch claw 14*d*. Further, the latch 14 has a spring locking hole 14*e*, and an engagement projection portion 14*f*. The latch 14 is pushed and rotated by the striker 30 at the time of closing the door 20. The latch 14 is biased toward the return position (position where the engagement projection portion 14*f* is abutted with the projection 11*m* of the body 11) by the latch return spring S1. The latch return spring S1 is coaxially assembled to the latch support shaft 18, and accommodated in the accommodating portion 11*a*1 of the body 11 together with the latch 14. One end of the latch return spring S1 is engaged to the body 11, and the other end is engaged to the spring locking hole 14*e* of the latch 14.

The latch support shaft 18 is inserted into the attachment hole 14*a* formed in the latch 14. The striker 30 comes into and retreats from the striker retaining groove 14*b* at the time of opening and closing the door 20. When the striker 30 comes into the striker retaining groove 14*b*, the striker 30 is engaged with the latch 14 in a sliding manner. As shown in FIG. 3, the striker 30 is hold by the striker retaining groove 14*b* and the striker insertion slit 12*f* of the base plate 12.

The half latch claw 14*c* is slidably engaged with an engagement portion 15*a* of the pawl 15 in a period from a door opened state to a door half-closed state. The half latch claw 14*c* restrains rotation of the latch 14 to the return position by engaging with the engagement portion 15*a* of the pawl 15 placed at a return position in the door half-closed state. The full latch claw 14*d* is slidably engaged with the engagement portion 15*a* of the pawl 15 in a period from a door almost-closed state to a door closed state shown in FIG. 5. The full latch claw 14*d* restrains the rotation of the latch 14 in the clockwise direction in FIG. 5 (rotation of the latch 14 to the return position) by engaging with the engagement portion 15*a* of the pawl 15 placed at the return position in the door closed state shown in FIG. 5.

The pawl 15 is rotatably supported on the base plate 12 and the sub base plate 13 via the pawl support shaft 19 together with the lift lever 17. The pawl 15 has the engagement portion 15*a*, a spring locking portion 15*b* and an engagement projection portion 15*c*. The pawl 15 is biased toward the return position (position where the engagement projection portion 15*c* is abutted with the stopper 16 assembled to the body 11) shown in FIG. 5 by the pawl return spring S2. In a state shown in FIG. 5, the pawl 15 is engaged with the latch 14 at the engagement portion 15*a* thereof in a manner that the rotation of the latch 14 to the return position (in the door opening direction) is restrained. As shown in FIG. 5, the engagement projection portion 15*c* can be abutted with a lower surface of the stopper 16 in a state where a front end thereof is inclined downward.

It should be noted that the pawl 15 and the pawl support shaft 19 are integrally formed, and the lift lever 17 is integrally rotatably assembled to the pawl support shaft 19. Therefore, in the case where the lift lever 17 is rotated in the counterclockwise direction in FIG. 4 via the lock mechanism (not shown) along with door opening operation of an outside door handle or an inside door handle (both not shown) provided in the door 20, the pawl 15 and the support shaft 19 are rotated in the clockwise direction in FIG. 5 from the return position shown in FIG. 5 against the biasing force of the pawl return spring S2. In a case the pawl 15 rotates in the clockwise direction in FIG. 5 from the return position when the engagement portion 15*a* of the pawl 15 engages with the latch 14, the latch 14 disengages from the pawl 15.

The pawl return spring S2 is assembled to the spring attachment portion 11*b* formed on the other side of the body 11 (the other side of the vertical wall W) at a position away from the rotation support portion (the position in which the pawl support shaft 19 is provided) of the pawl 15 by a predetermined amount toward the obliquely lower direction in FIG. 6. The pawl return spring S2 has the coil portion S2*a*, one end (a body side end) S2*b* engaged to the body 11, and the other end (a pawl side end) S2*c* engaged to the spring locking portion 15*b* of the pawl 15. The pawl side end S2*c* comes into the accommodating portion 11*a*2 of the body 11 through the through hole 11*k* provided in the body 11, and is engaged with the spring locking portion 15*b* of the pawl 15. Therefore, as shown in FIG. 4, the pawl side end S2*c* of the pawl return spring S2 is engaged to the spring locking position 15*b* of the pawl 15 disposed in the accommodating portion 11*a*2, whereas the coil portion S2*a* of the pawl return spring S2 is disposed outside of the accommodating portions 11*a*1, 11*a*2. That is, the pawl return spring S2 is engaged with the pawl 15 on one side of the body 11, whereas the coil portion S2*a* is disposed on the other side of the body 11.

In the above latch mechanism 10 of this embodiment, when the striker 30 is inserted through the striker insertion groove 11*c*, the striker 30 is nipped between the cantilever support portion 11*n* served as a part of the wall surface of the striker insertion groove 11*c* and the facing inner wall surface 11*c*1 of the striker insertion groove 11*c* facing the cantilever support portion 11*n*. By nipping the striker 30, a reactive force against nipping force from the striker 30 is acted to the cantilever support portion 11*n*. By the reactive force, the free front end 11*n*1 of the cantilever support portion 11*n* is moved downward in FIG. 6 and engaged with the receiving portion 11*o*. Therefore, the reactive force from the striker 30 is applied to the receiving portion 11*o* downward in FIG. 6 via the free front end 11*n*1. In this case, the support surface 13*c*1 of the metal support portion 13*c* is arranged on the lower side of the receiving portion 11*o*. That is, the support portion 13*c* (support surface 13*c*1) is arranged at the position such that the receiving portion 11*o* comes close to the support portion 13*c* (support surface 13*c*1) when the receiving portion 11*o* is deflected by the reactive force from the striker 30. Thus, even when the receiving portion 11*o* is deflected downward by the reactive force, a lower surface part (deformed surface) of the receiving portion 11*o* is brought into surface-surface contact with the support surface 13*c*1 of the support portion 13*c*, and the receiving portion 11*o* is restrained by the support surface 13*c*1, so that downward deflection of the receiving portion 11*o* is suppressed. That is, the support portion 13*c* is arranged relative to the receiving portion 11*o* so as to suppress the deflection of the receiving portion 11*o* due to the reactive force applied to the receiving portion 11*o* from the striker 30 via the cantilever support portion 11*n* when the striker 30 is inserted through the striker insertion groove 11*c*. As a result of suppressing the downward deflection of the receiving portion 11*o* by the support portion 13*c* in such a way, elastic deformation (deflection) of the receiving portion 11*o* is suppressed. That is, the deformation amount of the receiving portion 11*o* when the receiving portion 11*o* is deformed is decreased by the support portion 13*c*. Therefore, in the case of installing and using the latch mechanism 10 of the present embodiment in a vehicle, when large force is applied to the receiving portion 11*o* of the body 11 from the striker 30 via the cantilever support portion 11*n* of the body 11, the deformation of the receiving portion 11*o* is suppressed by the support portion 13*c*. Thus, operation reliability of the latch mechanism 10 can be improved.

In the present embodiment, the support portion 13*c* is integrally formed in the sub base plate 13. Thus, the operation reliability of the latch mechanism 10 can be improved without increasing the number of parts. Further, the support portion 13*c* of the present embodiment integrally formed in the sub base plate 13 is formed into a crank shape, and has the support surface 13*c*1 (upper surface) capable of being abutted with the deformed surface (lower surface) of the receiving portion 11*o* in the intermediate part, with one end 13*c*2 being connected to the part where the axial hole 13*a* of the sub base plate 13 is formed, and the other end 13*c*3 being connected to the part where the axial hole 13*b* of the sub base plate 13 is formed. Therefore, support rigidity of the support portion 13*c* can be enhanced, and the receiving portion 11*o* can be precisely supported by the support surface 13*c*1 thereof. Further, since the support surface 13*c*1 of the support portion 13*c* is brought into surface-surface contact with the receiving portion 11*o*, the reactive force applied to the receiving portion 11*o* from the striker 30 is divided. Therefore, deformation of the receiving portion 11*o* is effectively suppressed.

In the latch mechanism 10 of the present embodiment, as shown in FIG. 5, the cutout 11*j* of the body 11 forming the opening portion with the base plate 12 is provided in the lower part on one side of the body 11. The accommodating portions 11*a*1, 11*a*2 of the body 11 accommodating the latch 14 and the pawl 15 open downward on the lower side of the pawl 15. Further, the pawl return spring S2 is assembled to the spring attachment portion 11*b* formed on the other side of the body 11 at the position away from the rotation support portion (pawl support shaft 19) of the pawl 15 toward the lower direction, and the pawl side end S2*c* thereof comes into the accommodating portion 11*a*2 of the body 11 through the through hole 11*k* provided in the body 11 and is engaged with the spring locking portion 15*b* of the pawl 15.

Therefore, size of an opening formed on the lower side of the accommodating portions 11*a*1, 11*a*2 of the body 11 is not limited by the existence of the pawl return spring S2 and the spring attachment portion 11*b* of the body 11. Thus, an opening having necessary and sufficient size can be formed in the body 11. As a result, discharging ability of dust and the like entering an interior of the accommodating portions 11*a*1, 11*a*2 of the body 11 to an exterior of the body 11 is facilitated, so that a disadvantage due to accumulation of the dust and the like is effectively suppressed.

The pawl return spring S2 is configured to be assembled to the spring attachment portion 11*b* formed on the other side of the body 11 at the position away from the rotation support portion (pawl support shaft 19) of the pawl 15. Therefore, in comparison to a case where the pawl return spring S2 is coaxially assembled to the rotation support portion (pawl support shaft 19) of the pawl 15, a freedom degree of arrangement of the pawl return spring S2 can be increased.

In the latch mechanism 10 of the present embodiment, the pawl return spring S2 has the coil portion S2*a*, the body side end S2*b* on one end, and the pawl side end S2*c* on the other end. Further, the shaft portion 11*b*1 retaining the coil portion S2*a*, the arc wall portion 11*b*2 surrounding the coil portion S2*a*, and the locking portion 11*b*3 to be engaged with the body side end S2*b* of the pawl return spring S2 are provided in the spring attachment portion 11*b* formed in the body 11.

Accordingly, the pawl return spring S2 can be assembled after constituent parts except the pawl return spring S2 (such as the body 11, the base plate 12, the sub base plate 13, the latch 14, the pawl 15, the stopper 16, the lift lever 17, the support shaft 18 of the latch, the support shaft 19 of the pawl, and the latch return spring S1) are sub-assembled. Specifically, the pawl side end S2*c* of the pawl return spring S2 is inserted into the accommodating portion 11*a*2 of the body 11 through the through hole 11*k* of the body 11 and engaged with the spring locking portion 15*b* of the pawl 15, then, the coil portion S2*a* of the pawl return spring S2 is assembled to the retaining portion (11*b*1) of the spring attachment portion 11*b* formed in the body 11, and finally, the body side end S2*b* of the pawl return spring S2 is assembled to the locking portion 11*b*3 provided in the spring attachment portion 11*b*, so that the pawl return spring S2 is assembled to the sub-assembled parts. Therefore, the biasing force of the pawl return spring S2 does not applied to the sub-assembled parts during the constituent parts except the pawl return spring S2 are sub-assembled. Thus, favorable assembling of the sub-assembled parts can be achieved.

In the latch mechanism 10 of the present embodiment, as shown in FIG. 5, the stopper 16 for regulating the return position of the pawl 15 is assembled to the stopper attachment portion 11*i* (part expanding into a peak shape between the accommodating portions 11*a*1, 11*a*2) of the body 11. Further, the stopper 16 is arranged on the upper side of the engagement projection portion 15*c* of the pawl 15 biased in the counter-clockwise direction in FIG. 5 by the pawl return spring S2. The engagement projection portion 15*c* of the pawl 15 can be abutted with the lower surface of the stopper 16 in a state where the front end thereof is inclined downward. Therefore, the dust and the like are less likely accumulated between the engagement projection portion 15*c* of the pawl 15 and the stopper 16, thereby it can be prevented to change in the return position of the pawl 15 due to the accumulating dust and the like. Thus, a function of the pawl 15 (function of hindering the rotation of the latch 14 in the door opening direction at a predetermined position) can be stably obtained for a long time.

In the above embodiment, the support portion 13*c* for suppressing the deformation of the receiving portion 11*o* when the receiving portion 11*o* of the body 11 is deformed is integrally formed in the sub base plate 13. However, the support portion 13*c* may be provided separately from the sub base plate 13. It should be noted that in the case where the support portion 13*c* is provided separately from the sub base plate 13, it is necessary that the support portion 13*c* is connected to the sub base plate 13 or the base plate 12.

In the above embodiment, the shaft portion 11*b*1 (retaining portion) retaining the coil portion S2*a* of the pawl return spring S2 is provided in the spring attachment portion 11*b* of the body 11. However, a shape of the retaining portion retaining the coil portion S2*a* of the pawl return spring S2 can be appropriately changed.

The invention claimed is:

1. A latch mechanism for a vehicle door lock device, said latch mechanism comprising:

a resin body, the body having:

(a) an accommodating portion configured to receive a latch adapted to be pushed and rotated by a striker attached on the vehicle body side and a pawl engageable with and disengageable from a latch inside thereof;

(b) an insertion groove in which a striker is insertable;

(c) a cantilever support portion serving as a part of the insertion groove and adapted to nip the striker with facing inner wall surface of the insertion groove;

(d) an engaging portion engageable with a free front end of the cantilever support portion for restricting inclination of the cantilever support portion to a predetermined amount; and (e) a cushion accommodating portion on the engaging portion side of the cantilever support portion, the cushion accommodating portion configured to accommodate a cushion, which presses the cantilever support portion toward the striker;

a support portion for suppressing a deformation of the engaging portion when the free front end of the cantilever support portion engages with the engaging portion and the engaging portion deforms;

a base plate arranged on one side of the body;

a metal sub base plate arranged on the other side of the body, and wherein the base plate and the sub base plate rotatably support the latch and/or the pawl; and wherein the support portion is integrally formed in the sub base plate.

2. The latch mechanism of the vehicle door lock device according to claim 1, wherein the base plate has an attachment hole for assembling to a door, a latch axial hole for pivotally supporting a latch support shaft supporting the latch, a pawl axial hole for pivotally supporting a pawl support shaft supporting the pawl, and the insertion groove in which the striker is insertable, and the sub base plate has a latch axial hole for pivotally supporting the latch support shaft, and a pawl axial hole for pivotally supporting the pawl support shaft.

3. The latch mechanism of the vehicle door lock device according to claim 2, wherein the support portion has a support surface capable of being abutted with a deformed surface of the engaging portion in an intermediate part thereof, with one end being connected to a part where the latch axial hole of the sub base plate is formed, and with the other end being connected to a part where the pawl axial hole of the sub base plate is formed.

4. The latch mechanism of the vehicle door lock device according to claim 1, wherein the support portion is arranged at the position to which the engaging portion comes close by acting a force applied from the striker via the cantilever support portion when the striker is inserted through the insertion groove, and the deformation of the engaging portion is suppressed by restricting the deflection of the engaging portion by the support portion.

5. The latch mechanism of the vehicle door lock device according to claim 4, wherein the support portion has a support surface for restraining the engaging portion by contacting with the engaging portion when the force from the striker is applied to the engaging portion, and the support portion restricts the deflection of the engaging portion by restraining the engaging portion by the support surface.

6. The latch mechanism of the vehicle door lock device according to claim 5, wherein the base plate has an attachment hole for assembling to a door, a latch axial hole for pivotally supporting a latch support shaft supporting the latch, a pawl axial hole for pivotally supporting a pawl support shaft supporting the pawl, and the insertion groove in which the striker is insertable, and the sub base plate has a latch axial hole for pivotally supporting the latch support shaft, and a pawl axial hole for pivotally supporting the pawl support shaft.

7. The latch mechanism of the vehicle door lock device according to claim 1, wherein the metal sub base plate is a made of steel.

* * * * *